United States Patent [19]

Huber et al.

[11] Patent Number: 5,058,680

[45] Date of Patent: Oct. 22, 1991

[54] METHOD OF DETONATING A PERFORATING APPARATUS ON A TUBING INCLUDING LOWERING ONE END OF A PUMP AND A FIRING HEAD INTO SAID TUBING

[75] Inventors: Klaus B. Huber, Missouri City; A. Glen Edwards, Hockley; William M. Hill, Pearland; Antoni Miszewski, Missouri City, all of Tex.

[73] Assignee: Schlumberger Technology Corportion, Houston, Tex.

[21] Appl. No.: 559,128

[22] Filed: Jul. 26, 1990

Related U.S. Application Data

[62] Division of Ser. No. 353,988, Jun. 23, 1989.

[51] Int. Cl.[5] ..... E21B 43/00; E21B 43/1185

[52] U.S. Cl. ..... 166/297; 166/369; 166/381; 175/4.54

[58] Field of Search ..... 166/55.1, 55, 68, 105, 166/107, 108, 297, 369, 381; 175/4.54, 4.56, 4.6

[56] References Cited

U.S. PATENT DOCUMENTS

| | | | |
|---|---|---|---|
| 2,906,339 | 9/1959 | Griffin | 166/55 X |
| 4,237,976 | 12/1980 | Wilson | 166/105 X |
| 4,440,231 | 4/1984 | Martin | 166/106 X |
| 4,491,185 | 1/1985 | McClure | 175/4.56 |
| 4,512,418 | 4/1985 | Regalbuto et al. | 175/4.56 |
| 4,574,892 | 3/1986 | Grigar et al. | 175/4.56 X |
| 4,690,218 | 9/1987 | Sumner | 166/55.1 X |
| 4,886,126 | 12/1989 | Yates, Jr. | 175/4.54 |
| 4,898,244 | 2/1990 | Schneider et al. | 166/105 X |
| 4,917,189 | 4/1990 | George et al. | 175/4.54 |
| 4,924,952 | 5/1990 | Schneider | 175/4.54 |

FOREIGN PATENT DOCUMENTS

| | | | |
|---|---|---|---|
| WO8707925 | 12/1987 | PCT Int'l Appl. . | |
| WO88/04353 | 6/1988 | PCT Int'l Appl. . | |
| 2194316 | 3/1988 | United Kingdom | 175/4.54 |

OTHER PUBLICATIONS

Soviet Inventions Illustrated, P.Q. Sections, week 8539, Nov. 6, 1985, Derwent Publications LTD. SU-1 143-831 (Ivan).

SPE 18839 "Tubing Conveyed Perforating Sucker Rod Pumping Wells," 1989, Society of Petroleum Engineers.

Vann Systems brochure, 1988; (1) "Standard Rod Pump Completion," (2) Electric Submersible Pump Completion, and (3) Bypass Assembly.

*Primary Examiner*—Hoang C. Dang

*Attorney, Agent, or Firm*—Henry N. Garrana; John H. Bouchard

[57] ABSTRACT

A perforating gun having no firing head and no primary explosives is attached to a tubing string and the tubing string is run into a borehole. A new pump apparatus, having a firing head, is run into the tubing string until the pump firing head is adjacent the perforating gun. The firing head in the pump apparatus detonates, firing the perforating gun. If the firing head fails to detonate, one need only remove the pump apparatus from the tubing string in order to gain access to the firing head, for repair and replacement thereof. One need not remove the tubing string to gain access to the firing head.

15 Claims, 12 Drawing Sheets

| |
|---|
| FIG. 6a |
| FIG. 6b |
| FIG. 6c |

| |
|---|
| FIG. 8a |
| FIG.8b |
| FIG.8c |

| |
|---|
| FIG. 9a |
| FIG. 9b |
| FIG. 9c |

METHOD OF DETONATING A PERFORATING APPARATUS ON A TUBING INCLUDING LOWERING ONE END OF A PUMP AND A FIRING HEAD INTO SAID TUBING

This is a division of application Ser. No. 07/353,988 filed June 23, 1989.

BACKGROUND OF THE INVENTION

The subject matter of the present invention pertains to pumps for use in oil well boreholes, and more particularly, to a pump apparatus which includes a firing head for use with a perforating gun on a tubing string adapted to be disposed in such borehole.

Perforating guns, run into a borehole on a tubing string, function to perforate a formation around a borehole of an oil well for the purpose of withdrawing well fluids from the formation. Very often, the well fluids do not produce from the formation with sufficient pressure to propagate up the borehole to the well surface. As a result, a pump is installed in the tubing string for pumping the well fluids to the surface. The perforating gun with its firing head is first run into the borehole on the tubing string. When the perforating gun, with its firing head, is in place within the borehole, the pump is installed, within the tubing string, just above the perforating gun. The firing head of the gun detonates a set of charges in the gun, perforating the formation. The well fluids produce from the formation and the pump functions to pump the well fluids to the surface. However, if the firing head malfunctions and fails to detonate the charges, since the firing head is run into the borehole on the tubing string, the pump must first be withdrawn from the borehole, and the tubing string must secondly be withdrawn from the borehole in order to replace the firing head. A work over rig must be used to withdraw the pump and to withdraw the tubing string. This repair process takes several days to complete. Increased repair costs result. In addition, the firing head includes primary explosives. Since the tubing string includes the perforating gun with the firing head, in view of the primary explosives present in the firing head, for safety reasons, it is necessary to handle with care the placement of the perforating gun into the borehole. Therefore, a new design is needed which will allow for the repair and replacement of a firing head of a perforating gun without simultaneously requiring the withdrawal of the entire tubing string from a borehole, a repair which normally takes several days to complete.

SUMMARY OF THE INVENTION

It is a primary object of the present invention to design a pump which includes a firing head.

It is another object of the present invention to design a pump, adapted for use with a perforating gun in a tubing string, that includes a firing head.

It is a further object of the present invention to design a pump, including the firing head, that is adapted for insertion into a tubing string for use with a perforating gun disposed in such tubing string.

It is further object of the present invention to design a pump including a perforating gun firing head adapted for insertion into a tubing string, the tubing string including a perforating gun which does not contain a firing head nor any primary explosives.

In accordance with these and other objects of the present invention, a perforating gun is run into a borehole as part of the tubing string, the perforating gun having no primary explosives and no firing head. A pump is adapted for insertion into the tubing string, the pump including a perforating gun firing head. When the pump, including the firing head, is inserted into the tubing string, casing pressure is reduced, and the differential between the pressures in the tubing and the casing creates a series of events which causes a charge in the firing head to detonate thereby causing the charges in the perforating gun to detonate. At the time of firing, the firing head is disposed adjacent a booster of the perforating gun, the booster being connected to a primer cord, the primer cord being connected to various charges in the perforating gun. Detonation of the charge in the firing head ignites the booster, and sends a detonation wave down the primer cord to the charges in the perforating gun, detonating the perforating gun charges. If the firing head fails, one need only remove the pump from the borehole for the purpose of repair and replacement of the firing head, not the entire tubing string. It takes only a few hours to remove the pump and its firing head, whereas it takes about a full day to remove the tubing string with its firing head. As a result, considerable rigtime, labor and expense is saved.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein FIG. 1, including

DETAILED DESCRIPTION OF THE PREFERRED EMBODIMENT

Figure 1A:
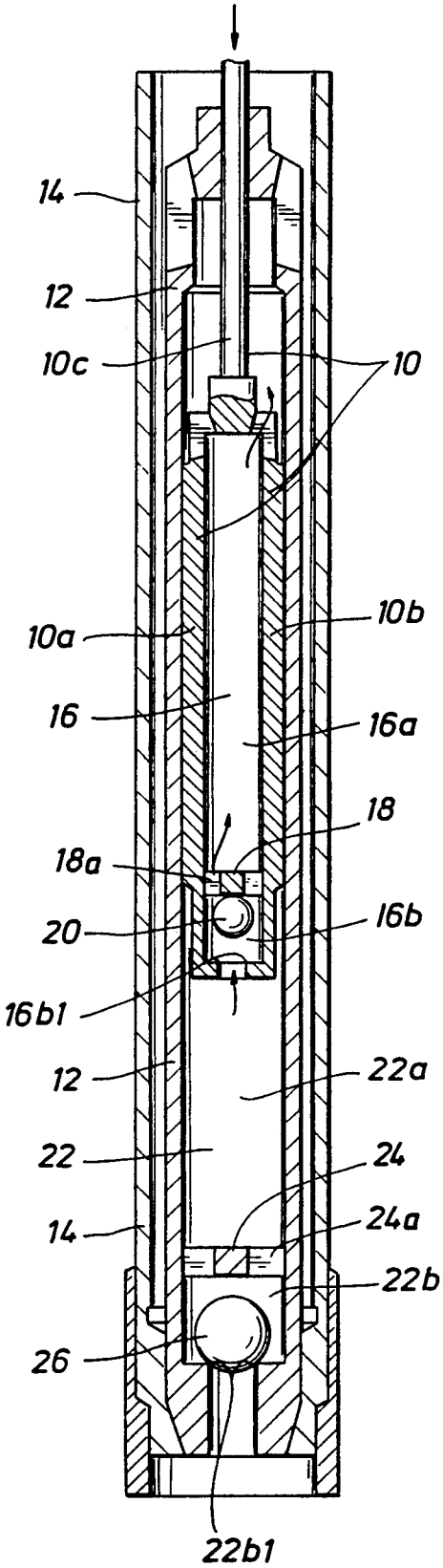
FIG. 1a (PRIOR ART)
FIGS. 1*a* and 1*b*, illustrates a prior art pump.
Figure 1B:
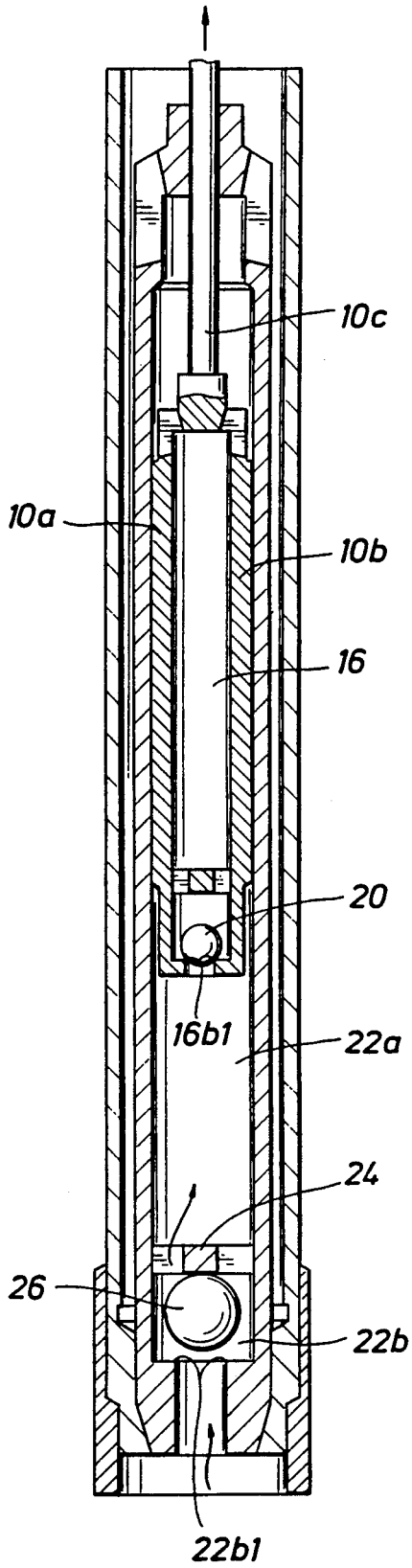
FIG. 1b (PRIOR ART)

Referring to FIGS. 1*a*–1*b*, a prior art pump, for pumping well fluids from a borehole, is illustrated.

In FIG. 1*a*, a prior art pump comprises a plunger 10 disposed within an inner housing 12, the inner housing being fixed to an outer housing 14. The plunger 10 is movably disposed within the inner housing 12, being adapted to move longitudinally within the inner housing of the pump. The plunger 10 includes an arm 10*a* and an arm 10*b* attached to a body portion 10*c*. The arms 10*a* and 10*b* define a cavity 16 within the plunger 10. A first baffle 18, disposed in cavity 16, connects arm 10*a* to arm 10*b* thereby redefining a first subcavity 16*a* and a second subcavity 16*b*. The first baffle 18 has at least one hole 18*a* disposed therethrough. The second subcavity 16*b* has a ball 20 disposed therein, the ball 20 being capable of floating within the second subcavity 16*b* between a seat 16*b*1 of plunger 10 and hole 18*a* of baffle 18. Furthermore, the inner housing 12 defines its own cavity 22 in which the plunger 10 is disposed. A second baffle 24 is disposed in the cavity 22 so as to define a first space 22*a* and a second space 22*b*. A hole 24*a* is disposed through the second baffle 24. A ball 26 is disposed in the second space 22*b* and is capable of floating within said second space between a seat 22*b*1 and hole 24*a*.

In operation, referring to FIG. 1*a*, assume a well fluid is disposed in first space 22*a* and in second space 22*b*; however, no such well fluid is disposed in cavity 16. Further, assume that plunger 10 is travelling downwardly in FIG. 1*a*. The downward travel of plunger 10 will force ball 26 against seat 22*b*1 thereby sealing the pump of FIG. 1*a* from its external environment, but will force ball 20 off seat 16*b*1 thereby enabling fluid in first space 22*a* to enter second subcavity 16*b* and through hole 18*a* into first subcavity 16*a*. When the plunger 10 travels upward in FIG. 1*b*, ball 20 is forced onto seat 16*b*1, but ball 26 is forced off seat 22*b*1. The well fluid in cavity 16 moves upwardly with the upward travel of plunger 10 while the well fluids disposed externally to the pump of FIG. 1*b* enter the second space 22*b* of the pump, and through hole 24*a* into the first space 22*a* of the pump.

Figure 2:
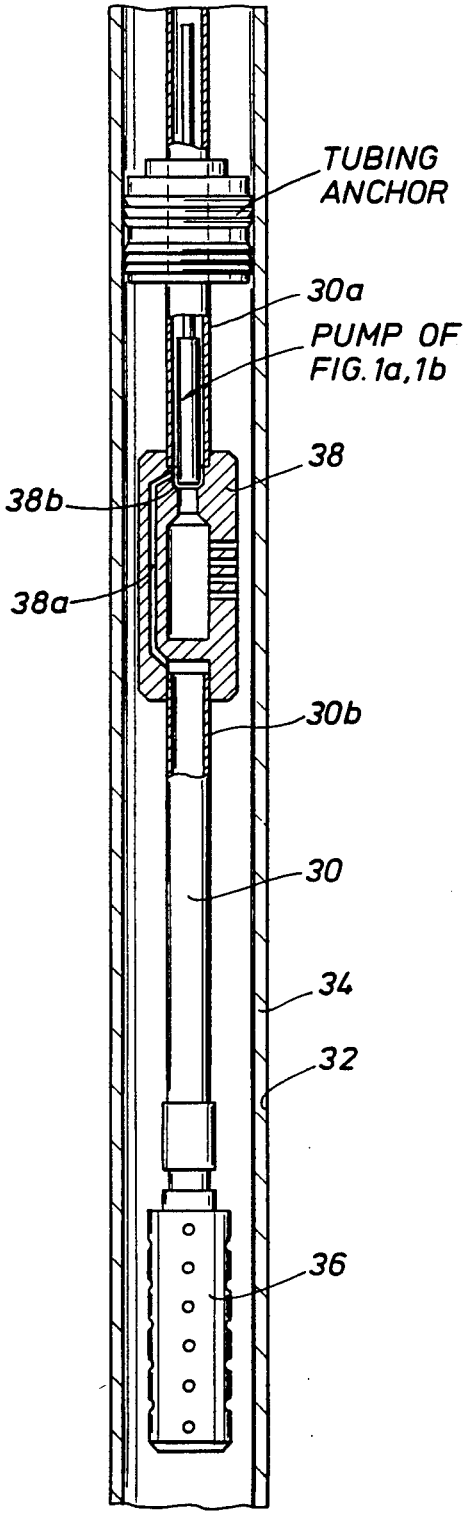
FIG. 2 (PRIOR ART)
FIG. 2 illustrates a prior art tubing string containing a perforating gun which includes a firing head and a bypass assembly that includes a section for mounting the pump of FIG. 1 therein.

Referring to FIG. 2, a tubing string is illustrated including a perforating gun and a bypass assembly for mounting the pump of FIG. 1*a*–1*b*.

In FIG. 2, a casing 34 is first disposed in a borehole 32. A tubing string 30 is disposed within the casing 34. A perforating gun 36 is connected to the bottom end of the tubing string 30, the gun 36 containing a firing head for firing a set of charges disposed within the gun 36. A bypass assembly 38 interconnects a first end 30*a* of the tubing string 30 to a second end 30*b* of the tubing string 30. The bypass assembly 38 includes a bypass 38*a* for connecting the end 30*a* of the tubing string to the end 30*b* of the tubing string thereby allowing the tubing pressure Pt in first end 30*a* of the tubing string to be transmitted to the second end 30*b* via the bypass 38*a*. The bypass assembly 38 also includes a seat 38*b* for receiving the pump shown in FIGS. 1*a*–1*b* thereby enabling the second space 22*b* of the pump in FIG. 1*a*/1*b* to communicate with the internal space of second end 30*b* of the tubing string 30 in FIG. 2. Bypass 38*a* is required because perforating gun 36 contains a differential pressure firing head. The differential pressure firing head compares casing pressure (the pressure between the casing 34 and the tubing string 30) with tubing pressure (the pressure within the tubing string 30) and fires the gun 36 when the tubing pressure exceeds the casing pressure by a predetermined amount. Therefore, it is necessary that the tubing pressure in end 30*a* of the tubing string 30 be communicated to end 30*b* of the tubing string in order to fire the perforating gun 36 at the proper time.

Figure 3:
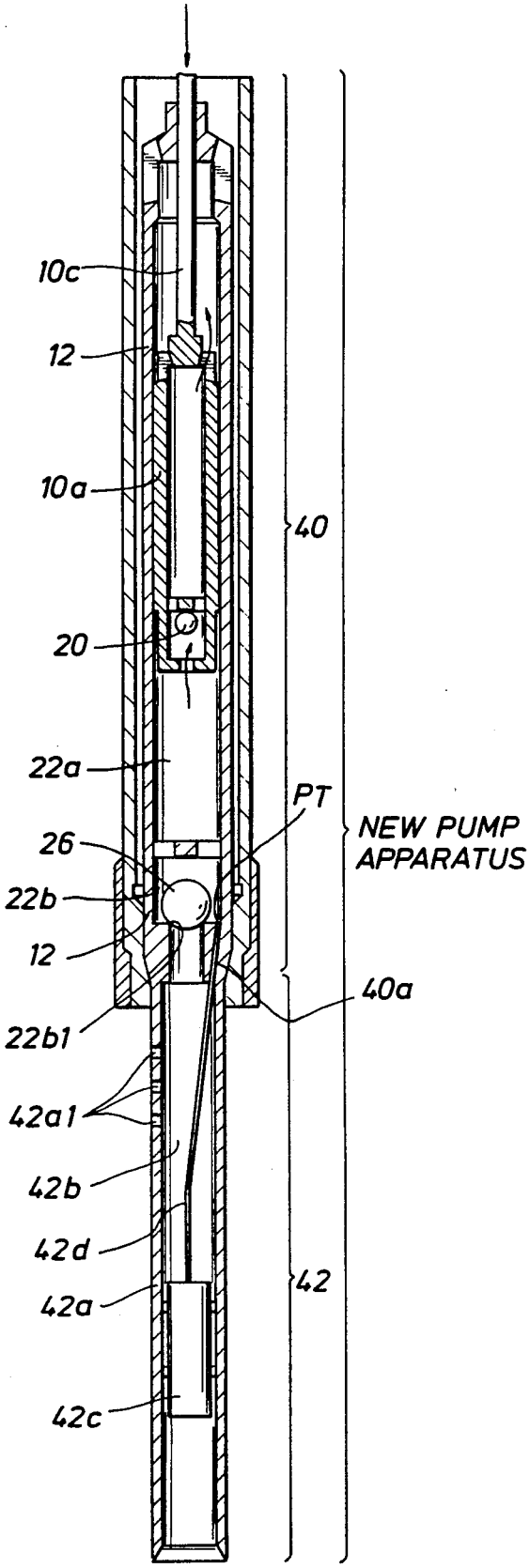
FIG. 3 illustrates the pump in accordance with the present invention which includes a firing head.

In operation, referring to FIG. 2, the firing head disposed in the perforating gun 36 compares tubing pressure with casing pressure, as described above, and fires the gun 36 when the tubing pressure exceeds the casing pressure by a predetermined amount. Well fluids flow into the tubing string 30 after the gun 36 is fired. The pump, shown in FIGS. 1*a*/1*b*, is disposed on seat 38*b* of the bypass assembly 38 within the tubing string 30 and pumps the well fluids within the tubing string 30 to the well surface. However, if the firing head in gun 36 fails to detonate, since the gun 36 was run into the borehole on the tubing string 30, it is necessary to first remove the pump from within the tubing string 30, and then to remove the tubing string 30 from the borehole 32 in order to obtain access to the firing head for repair and replacement thereof. This repair activity takes about a full day to complete, requiring the expenditure of a days worth of labor and expense. Referring to FIG. 3, a new pump apparatus in accordance with the present invention is illustrated, the pump apparatus being adapted to be inserted into a tubing string.

In FIG. 3, the new pump apparatus comprises a pump 40 and an extension member 42 threadedly connected to the pump 40. The pump 40 is identical to the pump illustrated in FIGS. 1*a* and 1*b* of the drawings, except for one modification made to the pump of FIGS. 1*a*, 1*b* which is illustrated in FIG. 3 and not illustrated in FIGS. 1*a*, 1*b*: in FIG. 3, a bypass or channel 40*a* is disposed through a bottom part of inner housing 12 so that, when ball 26 is firmly sitting on seat 22*b*1, the pressure in the tubing string "Pt" in first and second spaces 22*a*, 22*b* may be communicated to an internal space 42*b* of extension member 42 via the channel 40*a*. The extension member 42 includes a pipe section 42*a* connected, threadedly, to the bottom part of inner housing 12 of the pump 40. The pipe section 42*a* has holes or ports 42*a*1 disposed through a wall thereof. A firing head 42*c* is firmly connected to the wall of pipe section 42*a*, the firing head being used in association with a special perforating gun disposed in the tubing string (illustrated in FIG. 4). As will be noted in more detail below, the special perforating gun contains no firing head and no primary explosives, since the firing head for use with the special perforating gun is, instead, disposed in the extension member 42 of the new pump apparatus. A tube 42*d* connects the firing head 42*c* in the extension member 42 to the channel 40*a* in the bottom part of inner housing 12 of pump 40 so that the tubing pressure "Pt" in first and second spaces 22*a*, 22*b* of pump 40 is communicated to the firing head 42*c* in extension member 42 via channel 40*a* and tube 42*d*. The firing head 42*c* utilizes differential pressure (casing pressure versus tubing pressure) to fire a charge that detonates the charges in the special perforating gun. Therefore, the tubing pressure "Pt" must be communicated to the firing head 42*c* from the internal spaces of the pump 40.

Figure 4:
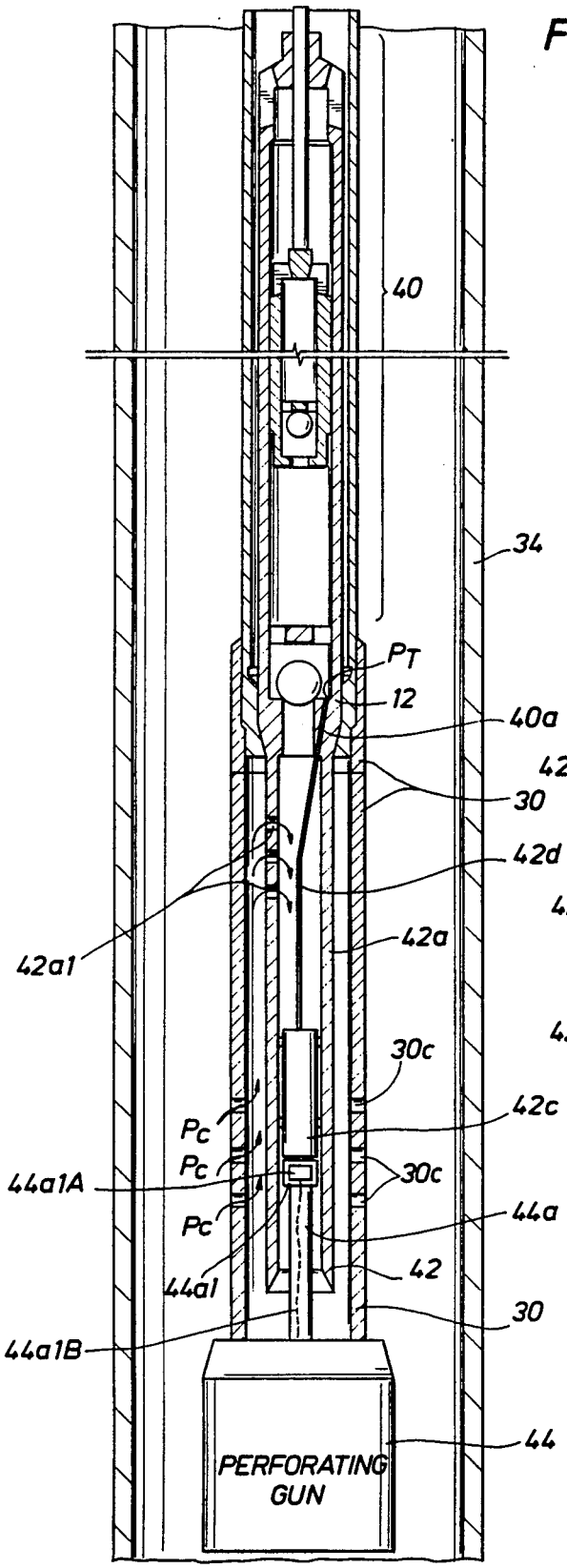
FIG. 4 illustrates the pump of FIG. 3, that includes a firing head, inserted into a tubing string which includes a perforating gun that does not contain a firing head nor any primary explosives.

Referring to FIG. 4, the new pump apparatus of FIG. 3, inserted in a tubing string disposed in a borehole, is illustrated.

In FIG. 4, the new pump apparatus, which includes pump 40 and extension member 42 (inclusive of pipe 42*a*, firing head 42*c*, and tube 42*d*), is inserted into a tubing string 30. A special perforating gun 44 is connected to a bottom end of the tubing string 30 and is run into a borehole on the tubing string 30. The perforating gun 44 is deemed "special", since it contains no firing head and contains no primary explosives; rather, it contains only the normal capsule charges for perforating a formation upon detonation. A casing 34 encloses the borehole in the normal manner. A plurality of holes 30*c* are disposed through a wall of the tubing string 30 for passage of the casing pressure "Pc" from an annular space between tubing string 30 and casing 34 to an internal space within the tubing string 30, as illustrated in FIG. 4. An extender tube 44*a* is connected to the perforating gun 44, and extends upwardly into the tubing string 30, and into extension member 42 of the pump apparatus until a head 44*a*1 of the extender tube 44*a* nearly abuts against the firing head 42*c*. A booster 44*a*1A is disposed in the head 44*a*1 of extender tube 44*a* and a primer cord 44*a*1B connects the booster 44*a*1A to the special perforating gun 44.

Figure 5:
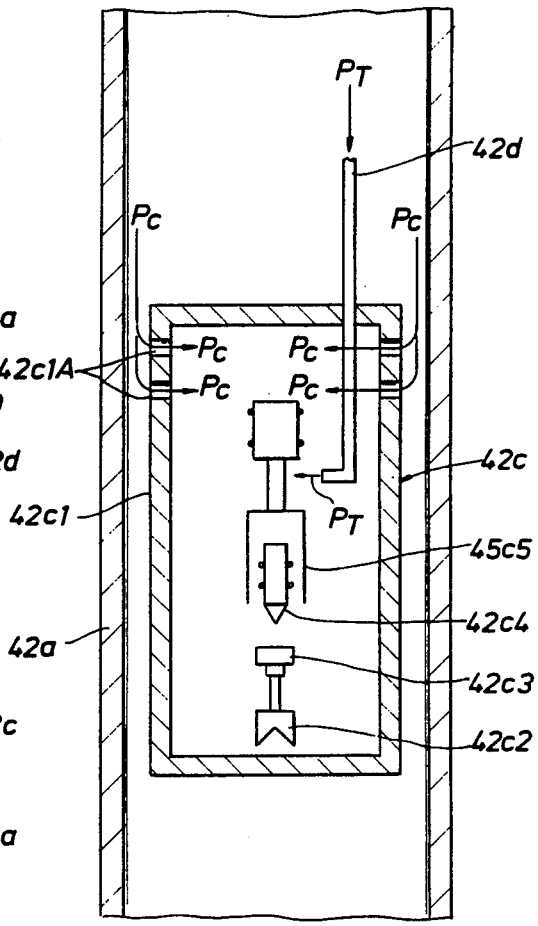
FIG. 5 illustrates a detailed construction of the firing head of FIG. 3.

Referring to FIG. 5, a detailed construction of the firing head 42*c* of FIGS. 3 and 4 is illustrated.

In FIG. 5, the firing head 42*c* comprises a container 42*c*1 having a wall, a plurality of holes 42*c*1A being disposed through the wall of said container 42*c*1. The holes 42*c*1A provide a port through which the casing pressure Pc is supplied to the firing head. The container 42*c*1 is illustrated in FIG. 5 as being disposed within the pipe section 42*a* of the extension member 42 of FIG. 3. A capsule or shape charge 42*c*2 is connected to a detonator 42*c*3; when the detonator 42*c*3 is impacted, it fires the charge 42*c*2. A firing pin 42*c*4 is disposed above the detonator 42*c*3 in the normal manner. A lock member 42*c*5 is disposed over the firing pin 42*c*4, shielding the firing pin 42*c*4 from the tubing pressure "Pt" as long as the casing pressure "Pc" is greater than the tubing pressure "Pt". Tube 42*d* in FIG. 5 supplies the tubing pressure Pt, said tubing pressure Pt being applied to an intermediate section of said lock member 42*c*5 in FIG. 5. If the firing pin 42*c*4 were exposed to the tubing pressure Pt without being shielded by the lock member, said tubing pressure would propel the firing pin 42*c*4 onto the detonator 42*c*3, prematurely firing the charge 42*c*2. The lock member 42*c*5 is movable longitudinally, upwardly and downwardly in FIG. 5, its position relative to the firing pin 42*c*4 being dependant upon the magnitude of the tubing pressure Pt on the intermediate section of the lock member relative to the magnitude of the casing pressure Pc on a top part of said lock member 42*c*5. The casing pressure Pc, as shown in FIG. 4, is the pressure between the casing 34 and the tubing string 30. As shown in FIG. 4, the casing pressure Pc enters holes 30*c* in tubing string 30, enters holes 42*a*1 of the pipe section 42*a* of the extension member of the new pump apparatus, and, as shown in FIG. 5, enters holes 42*c*1A of the firing head 42*c*. This casing pressure Pc is compared with the tubing pressure Pt, and, if the casing pressure Pc is less than the tubing pressure Pt, the lock member 42*c*5 moves upwardly over the firing pin, exposing the firing pin 42*c*4 to the tubing pressure Pt. The tubing pressure Pt propels the pin 42*c*4 onto the detonator 42*c*3, exploding the charge 42*c*2.

A functional description of the new pump apparatus of the present invention, in conjunction with the special perforating gun disposed in the tubing string, is set forth in the following paragraphs with reference to FIGS. 3–5 of the drawings.

A casing 34 is set in a borehole and a tubing string 30, having a special perforating gun 44 connected thereto, is run into the borehole. The perforating gun 44 contains no firing head, nor does it contain any primary explosives; rather, it contains a plurality of capsule charges connected to a primer cord for detonating when the primer cord carries the appropriate energy to the charges. The new pump apparatus is then inserted into the tubing string 30 until the head 44*a*1A of the extender tube 44*a* of the perforating gun 44 abuts against the firing head 42*c* disposed in the pipe section 42*a* of the extension member 42 portion of the new pump apparatus. Tubing pressure Pt is conducted to the firing head 42*c* via channel 40*a* in the inner housing 12 of pump 40 and tube 42*d* of the extension member 42. As shown in FIG. 4, casing pressure Pc, the pressure between casing 34 and tubing string 30, is conducted into the tubing string 30 via holes 30*c* in the tubing string 30, into the extension member 42 via holes 42*a*1 in the pipe section 42*a* of extension member, and into the firing head 42*c* via holes 42*c*1A in container 42*c*1 of the firing head 42*c*. When casing pressure Pc is reduced, below the tubing pressure Pt, lock member 42*c*5 moves upwardly, in the drawing of FIG. 5, exposing the firing pin 42*c*4 to the tubing pressure Pt. The tubing pressure Pt propels the firing pin 42*c*4 downwardly, onto detonator 42*c*3, which explodes the charge 42*c*2. The formation around the borehole casing begins to produce well fluids, and the pump 40 of FIG. 4 begins to pump the well fluids to the surface, in the manner illustrated with reference to FIGS. 1*a*, 1*b* of the drawings. If the charge fails to detonate, the firing head 42*c* must be removed for repair and/or replacement. In the prior art, it was necessary to remove the tubing string 30 to gain access to the firing head, an action which took the good part of an entire day to complete. With the present invention shown in FIG. 3, and more particularly, in FIG. 4, all one need do is remove the pump apparatus 40, 42 from the tubing string 30 in order to gain access to the firing head 42*c*, an action which takes only about one-half hour to complete.

Figures 6, 6A:
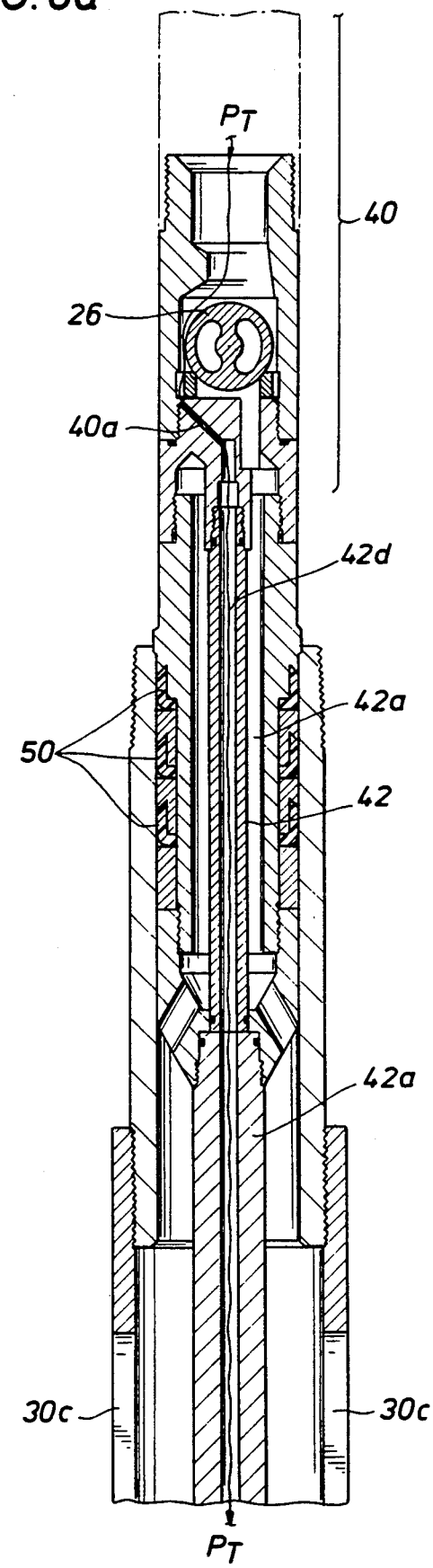
FIG. 6, including
FIGS. 6*a*–6*c*, represents a more detailed implementation of the embodiment illustrated in FIGS. 4 and 5.
Figure 6B:
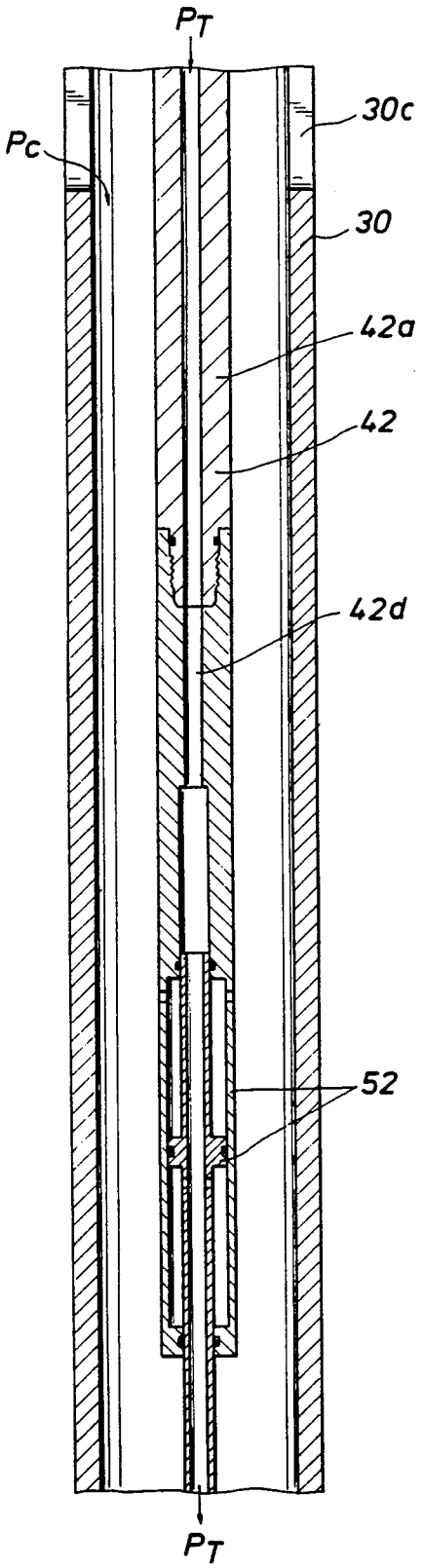
Figure 6C:
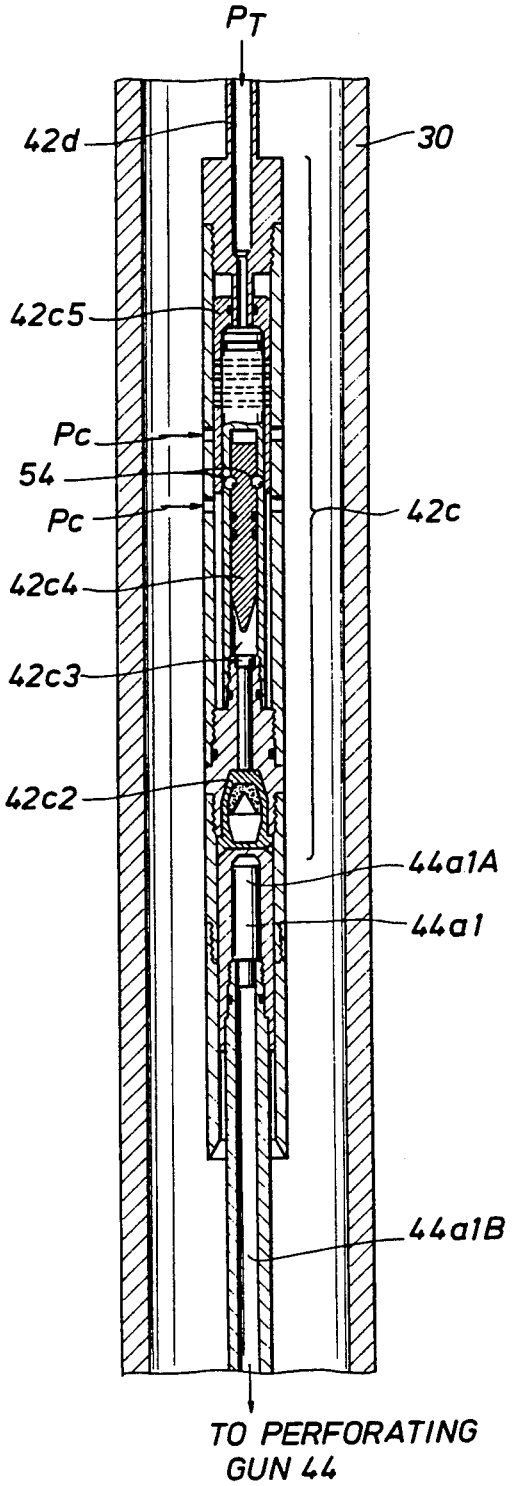

Referring to FIG. 6, a more detailed construction of the embodiment of invention shown in FIG. 4 is illustrated. The feature numerals that were used in FIG. 4 will also be used to designate the same corresponding parts in FIG. 6. In FIG. 6, pump 40 includes ball 26, similar to the pump 40 and ball 26 shown in FIG. 3. Extension member 42, connected to the pump 40, includes pipe section 42*a* extending from pump 40 to the firing head 42*c*. Inside pipe section 42*a*, tube 42*d* carries the tubing pressure "Pt" to the firing head 42*c*. The new elements in FIG. 6 include a seal 50 and a pressure compensated slip joint 52. The functional operation of the embodiment of invention shown in FIG. 6 is identical to that of FIG. 4. Tubing pressure "Pt" is communicated to the tube 42*d* via bypass or channel 40*a*. The tubing pressure "Pt" is conducted through tube 42*d* of FIGS. 6*a* to 6*b* until it reaches the firing head 42*c*. As noted in FIG. 5, a lock member 42*c*5 is disposed over the firing pin 42*c*4, shielding the pin 42*c*4 from the tubing pressure "Pt" as long as the casing pressure "Pc" is greater than the tubing pressure "Pt". Lock member 42*c*5 is movable longitudinally, upwardly and downwardly in FIG. 6c. If the casing pressure Pc is less than the tubing pressure Pt, lock member 42c5 moves upwardly over firing pin 42c4. A set of ball bearings 54 fall into a recess when lock member 42c5 moves upwardly by a predetermined amount, at which time, the tubing pressure propels the pin 42c4 onto detonator 42c3, exploding charge 42c2. Note that, if for some reason, firing head 42c fails to detonate, pump 40 is withdrawn from the borehole; since the firing head 42c is connected to the pump 40 via pipe section 42a, when the pump is being withdrawn from the borehole, the firing head is also being withdrawn from the borehole. The tubing string 30 remains in the borehole. The perforating gun 44, connected to the tubing string 30, contains no primary explosives, since the firing head is on the pump, not on the tubing string. When the tubing string 30 is run into the borehole, since the perforating gun on the tubing string contains no primary explosives, it is not necessary to be as greatly concerned about the safety factor involved in handling the tubing string, relative to the prior art approach, wherein the perforating gun containing a firing head was run into the borehole on the tubing string. Since the firing head is being removed from the borehole when the pump is being withdrawn, and not when the tubing string is being withdrawn, considerable expense in terms of rigtime is saved.

Figure 7A:
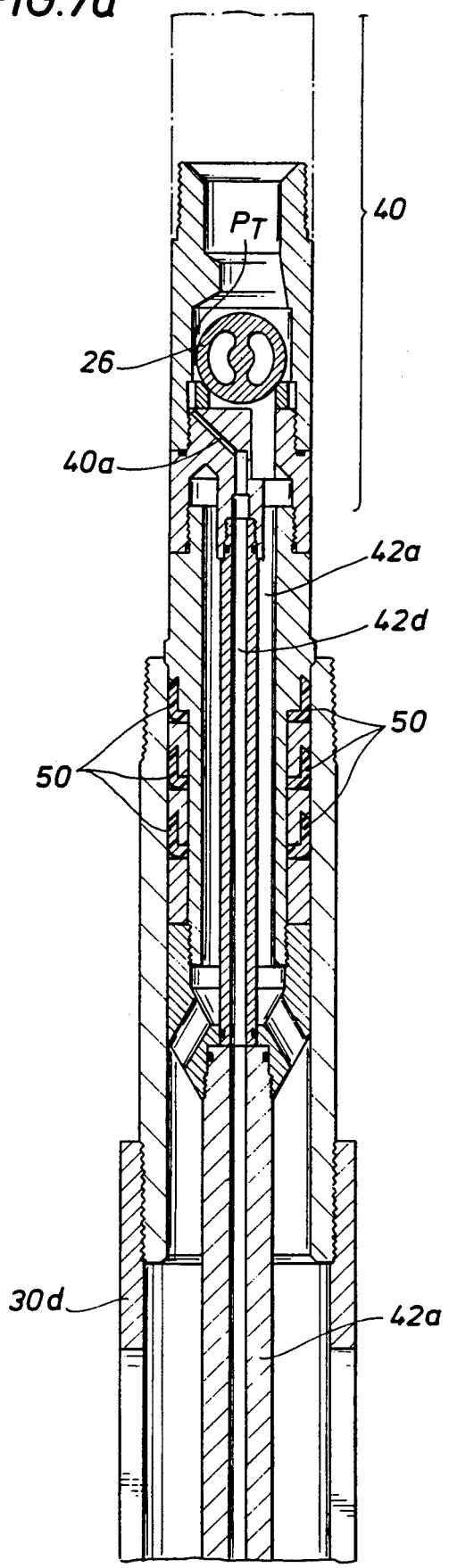
FIGS. 7*a*–7*c*, represents a first alternate embodiment of the invention illustrated in FIGS. 4 and 5.
Figure 7:
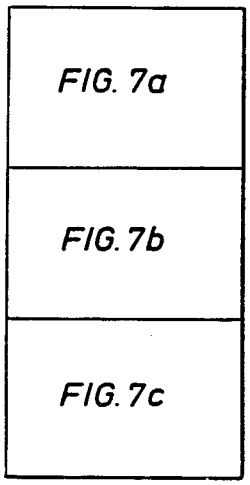
FIG. 7, including
Figure 7B:
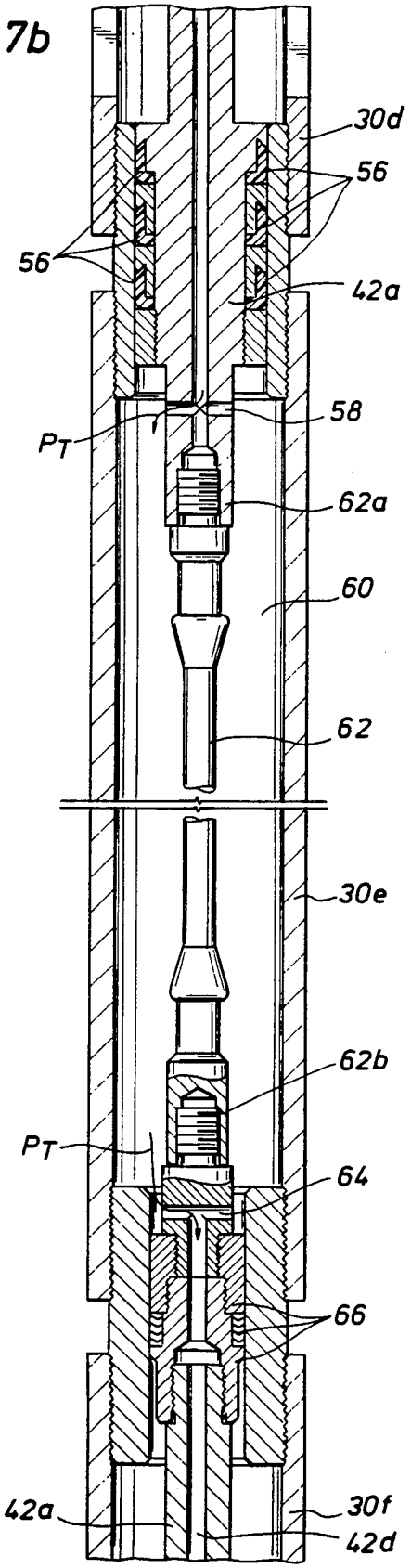
Figure 7C:
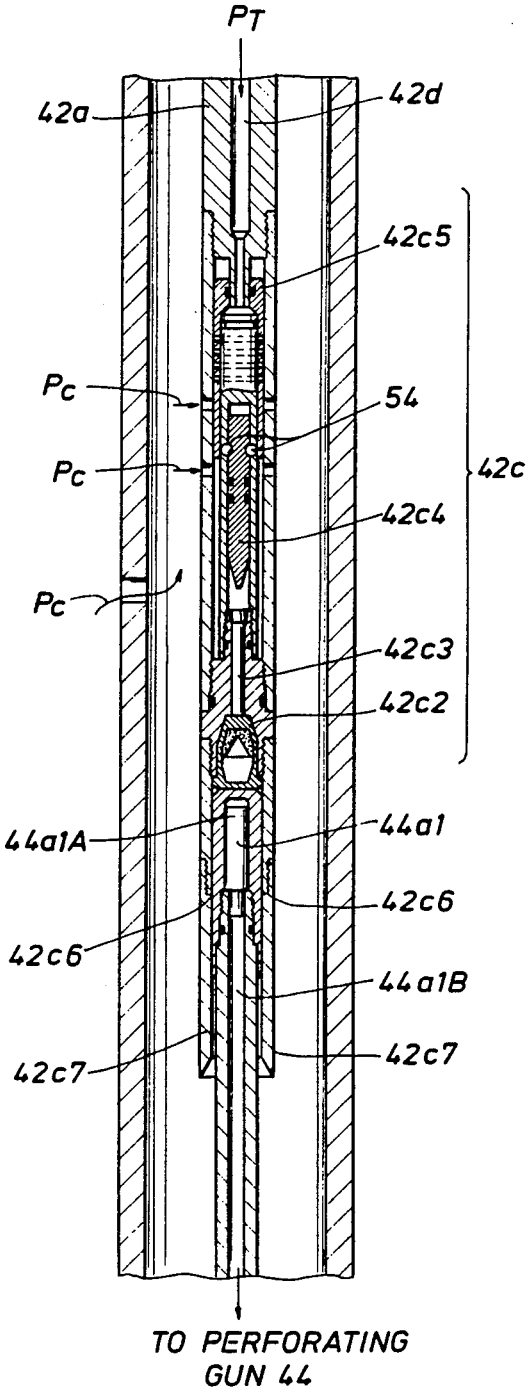

Referring to FIG. 7, including FIGS. 7a–7c, a first alternate embodiment of the invention shown in FIG. 4 is illustrated.

In FIG. 7, it is noted that the distance between the firing head 42c and the booster 44a1A may vary from well to well when the pump 40 and its attached extension member 42 is run into the borehole until the bottom part of pump 40 rests on the top part of tubing string 30. Therefore, it is difficult to guarantee that the firing head 42c in FIG. 4 will always be immediately adjacent to the booster 44a1 when the pump 40 and its attached extension member 42 rests on the top part of tubing string 30. Consequently, one solution involves increasing the distance between the firing head 42c and the bottom part of the pump 40 thereby placing the firing head in the pump extension member closer to the booster. In order to implement this solution, as shown in FIG. 7b, the tubing string 30 is divided into three parts: a top part 30d, an intermediate part 30e, and a bottom part 30f. As in FIG. 4, the bypass or channel 40a of pump 40 is connected to tube 42d for communicating tubing pressure from pump 40 to the firing head 42c. Pipe section 42a of the extension member 42 surrounds the tube 42d. As noted in FIG. 6, seal 50 enables a portion of pipe section 42a nearest the pump 40 to be inserted into one end of the top part 30a of the tubing string 30. When the portion of pipe section 42a nearest the pump 40 is inserted into the one end of the top part 30d of tubing string 30, the pipe section 42a at pump 40 communicates directly with firing head 42c via an intermediate part 30b of tubing string 30 to be discussed in more detail below. The other end of the top part 30d of tubing string 30 interfaces with one end of the intermediate part 30e of the tubing string via a second seal 56, which seal 56 is functionally identical to seal 50. The top part 30d of tubing string 30 may be separated from the intermediate part 30e of tubing string 30 by merely unscrewing the two parts 30d and 30e. The pipe section 42d in top part 30d of tubing string 30 communicates tubing pressure "Pt" with pipe section 42d in the bottom part 30f of tubing string 30 via (1) a port 58 disposed at the bottom end of pipe section 42a of top part 30d of tubing string 30, (2) an annular space 60 disposed within the intermediate part 30e of tubing string 30, and (3) a port 64 disposed at the top end of pipe section 42a of bottom part 30f of tubing string 30, as indicated by the arrow in the intermediate part 30e labelled "Pt". In the intermediate part 30e of tubing string 30, one end of a sucker rod 62 is slidably connected to the pipe section 42a of the top part 30d of tubing string 30 and the other end of the sucker rod 62 is also slidably connected to the pipe section 42a within the bottom part 30f of the tubing string. Joint 62a defines the slidable connection made between the one end of the sucker rod 62 and pipe section 42a within the top part 30d of tubing string 30, and joint 62b defines the slidable connection made between the other end of the sucker rod 62 and pipe section 42a within the bottom part 30f of tubing string 30. A further seal 66 seals intermediate part 30e of tubing string 30 to the bottom part 30f of tubing string 30. In order to separate the intermediate part 30e from bottom part 30f of tubing string 30, one need only unscrew the two parts of the tubing string. In the meantime, tubing pressure Pt is communicated between top part 30d to bottom part 30f of tubing string 30 via pipe section 42a in the top part 30d, port 58, annular space 60, port 64, and pipe section 42a in the bottom part 30f of tubing string 30. In FIG. 7c, pipe section 42a communicates with an underside of lock member 42c5; when the tubing pressure Pt on the underside of lock member 42c5 is greater than the casing pressure Pc, the lock member 42c5 moves upwardly in FIG. 7c. At this time, ball bearings 54 fall into the exposed annular space. Since the ball bearings 54 no longer hold the firing pin 42c4 in place, and since Pt is greater than Pc, the tubing pressure Pt propels firing pin 42c4 onto detonator 42c3. A detonating cord interconnects detonator 42c3 to charge 42c2. Charge 42c2 detonates thereby inducing a detonating wave or charge in the booster 44a1A, and the detonating wave is transmitted to perforating gun 44 via primer cord 44a1B. If the firing head 42c fails, one need only pull pump 40 to the surface; when this is being accomplished, the following items are also simultaneously pulled to the well surface: (1) pipe section 42a in top part 30d, (2) sucker rod 62, (3) pipe section 42a in bottom part 30f and (4) firing head 42c, down to and including charge 42c2.

The firing head 42c in FIG. 7c further includes a finger tube 42c7. A latch ring 42c6 is disposed in the walls of the finger tube 42c7. The latch ring 42c6 holds the finger tube 42c7 of the firing head 42c to the booster head 44a1. When the pump 40 and its attached firing head 42c are pulled to the well surface, since the booster 44a1 resists movement toward the well surface, the latch ring 42c6, which firmly contacts the booster but is physically a part of the firing head, shatters in response to the upward movement of the firing head thereby separating the firing head 42c from the booster head 44a1.

In operation, referring to FIGS. 7a–7c, tubing pressure "Pt" is provided from the pump 40 and passes through channel or bypass 40a into tube 42d which is enclosed by pipe section 42a within the top part 30d of tubing string 30. The Pt passes through tube 42d of top part 30d, through port 58, into annular space 60 in the intermediate part 30e of tubing string 30, into port 64, into tube 42d of the bottom part 30f of tubing string 30, and finally contacts the underside of lock member 42c5 of FIG. 7c. If the Pt is greater than the casing pressure "Pc", the lock member 42c5 moves upwardly, allowing the ball bearings 54 to fall into the exposed annular space. This releases the firing pin 42c4. Since the Pt is greater than the Pc, the Pt propels the released firing pin 42c4 downwardly onto detonator 42c3. Since the shape charge 42c2 is connected to the detonator, the detonator 42c3 sends a detonation wave downwardly to charge 42c2, detonating the charge. This, in turn, initiates a detonation wave in the booster head 44a1, the detonation wave propagating down primer cord 44a1B to the perforating gun 44, detonating the charges in the gun 44. If firing head 42c fails to detonate, one need only pull the pump 40 to the surface; the pipe section 42a in top part 30d, sucker rod 62, pipe section 42a in bottom part 30f and firing head 42c, being connected to the pump 40, will accompany the pump to the surface of the well. There is no need to pull the tubing string 30 to the surface in order to gain access to the firing head 42c.

Figures 8, 8A:
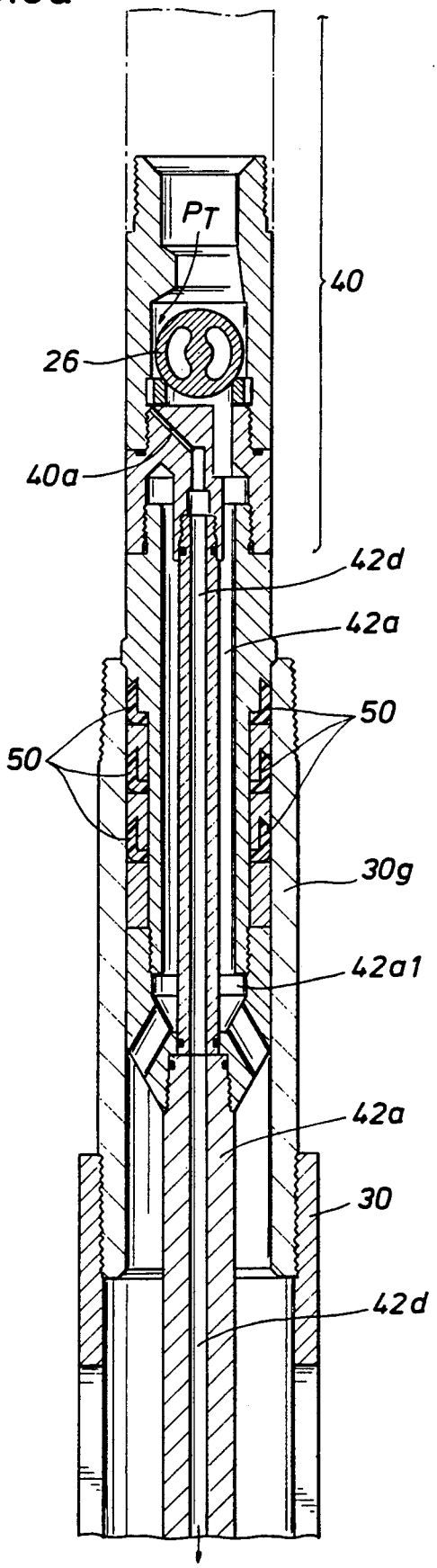
FIG. 8, including
FIGS. 8*a*–8*c*, represents a second alternate embodiment of the invention illustrated in FIGS. 4 and 5.

Referring to FIG. 8, a second alternate embodiment of the invention shown in FIG. 4 is illustrated.

Figure 8B:
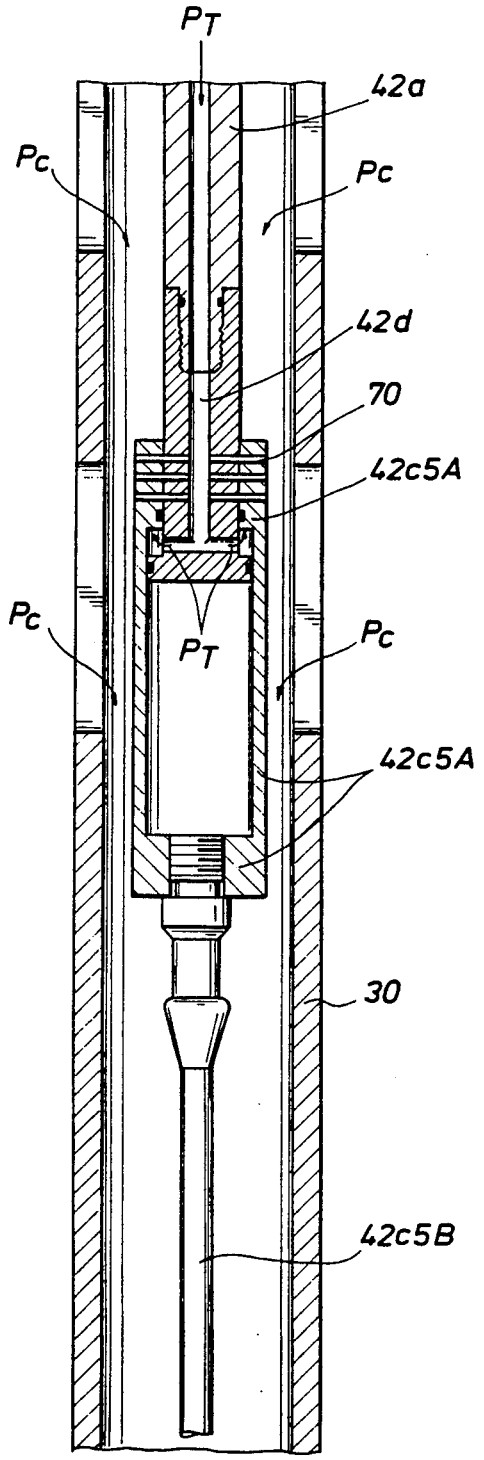
Figure 8C:
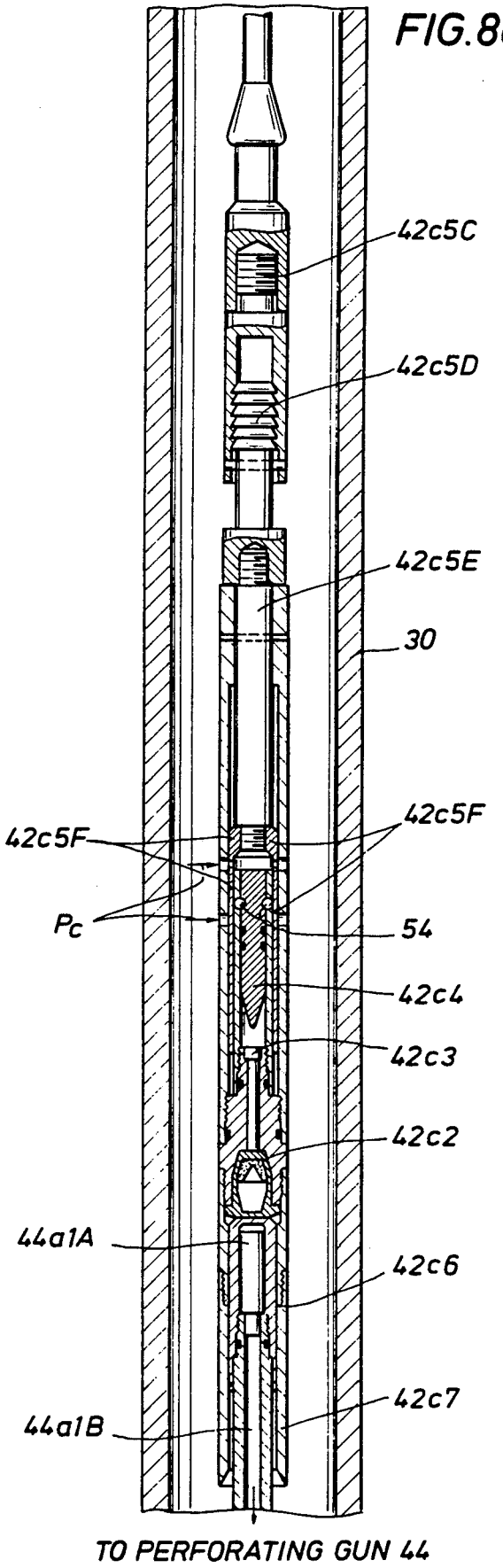

In FIG. 8, contrary to the FIG. 7 embodiment, the tubing string 30 in FIG. 8 comprises a single unitary structure. A channel or bypass 40a in pump 40 allows the interior of pump 40 to communicate with tube 42d. The tube 42d is enclosed by pipe section 42a, as in the other embodiments. As shown in FIG. 8a, a portion 42a1 of pipe section 42a is inserted into a top portion 30g of tubing string 30. A seal 50, shown in FIG. 8a, seals the portion 42a1 of pipe section against the top portion 30g of the tubing string. Pipe section 42a in FIG. 8a is connected to lock member 42c5; however, lock member 42c5, in this embodiment of invention, comprises the following parts: first lock member 42c5A and second lock member 42c5B shown in FIG. 8b, and third, fourth, fifth and sixth lock members 42c5C, 42c5D, 42c5E, and 42c5F, respectively, shown in FIG. 8c. Pipe section 42a of FIG. 8a connects to pipe section 42a of FIG. 8b. The pipe section 42a of FIG. 8b connects to first lock member 42c5A. The tubing pressure "Pt" is conducted from pump 40, through channel or bypass 40a, through tube 42d of pipe section 42a in FIG. 8a, and through tube 42d in FIG. 8b, entering lock member 42c5A, and is applied against an underside of lock member 42c5A, as noted in FIG. 8b of the drawings. The first lock member 42c5A is connected to one end of second lock member 42c5B, which second lock member 42c5B is a sucker rod. The other end of sucker rod second lock member 42c5B is connected to third lock member 42c5C, the third lock member 42c5C being connected to fourth and fifth lock members 42c5D and 42c5E. Note carefully the manner in which fifth lock member 42c5E is connected to sixth lock member 42c5F, and note the configuration of sixth lock member 42c5F. Sixth lock member 42c5F includes, in cross section as shown in FIG. 8c, a left hand portion and a right hand portion, the left and right hand portions of the sixth lock member 42c5F holding ball bearings firmly against firing pin 42c4. When the tubing pressure Pt is applied against the underside of first lock member 42c5A, as shown in FIG. 8b, the first lock member 42c5A moves upwardly, shearing pin 70. When first lock member 42c5A moves upwardly, second, third, fourth, fifth, and sixth lock members 42c5B through 42c5F also move upwardly, in the drawing. When the sixth lock member 42c5F moves upwardly, the left and right hand portions of the sixth lock member 42c5F also move upwardly. Eventually, the left and right hand portions of sixth lock member 42c5F pass over ball bearings 54, releasing the ball bearings from their firm contact with firing pin 42c4. When the ball bearings are released, they fall into the annular recess around firing pin 42c4, releasing the firing pin. The firing pin 42c4 moves downwardly in FIG. 8c, impacting detonator 42c3. The impact with detonator 42c3 firing charge 42c2. The charge 42c2 initiates a detonation wave in booster 44a1A, which wave propagates down primer cord 44a1B to perforating gun 44, firing the charges in the gun. If the firing head 42c fails, and charge 42c2 fails to detonate, one need only pull pump 40 out of the well. When pump 40 is pulled to the well surface, latch ring 42c6 in finger tube 42c7 is sheared, and finger tube 42c7 moves upwardly, over and away from the booster 44a1. In addition, pipe section 42a in FIGS. 8a and 8b, lock members 42c5A through 42c5F, and firing head 42c all accompany the pump 40 to the well surface. There is no need to pull the tubing string 30 to the well surface in order to gain access to the firing head.

Figures 9, 9A:
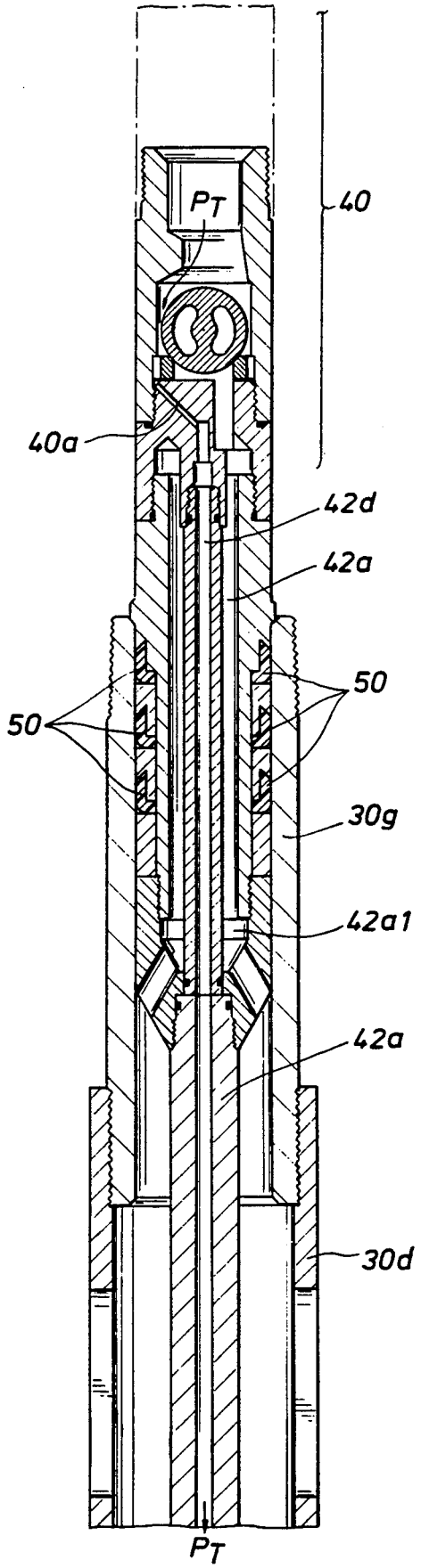
FIG. 9, including
FIGS. 9*a*–9*c*, represents a third alternate embodiment of the invention illustrated in FIGS. 4 and 5.
Figure 9B:
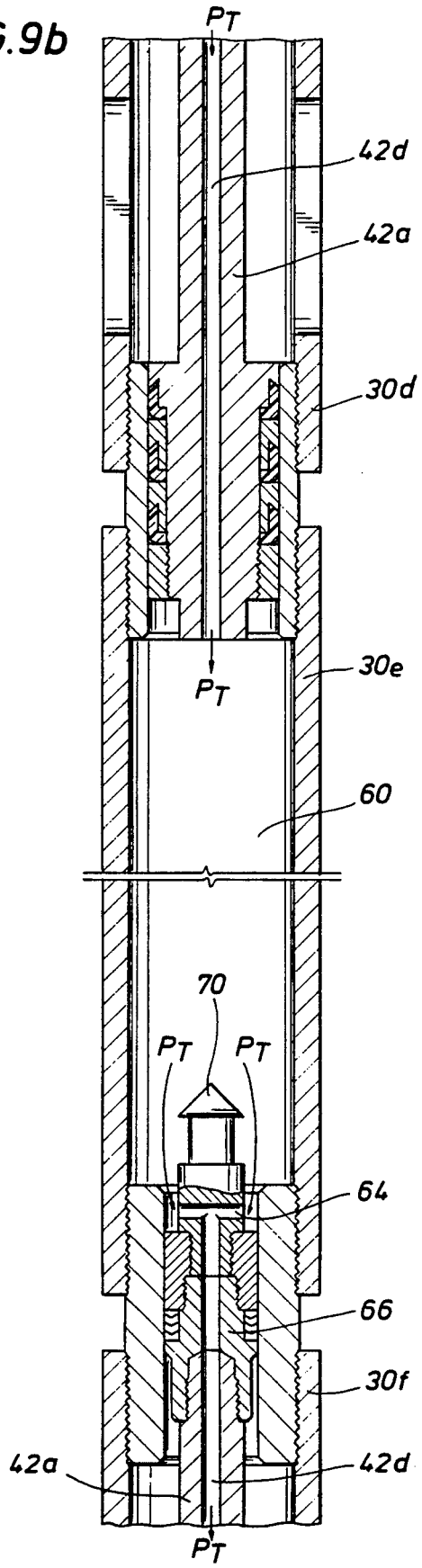
Figure 9C:
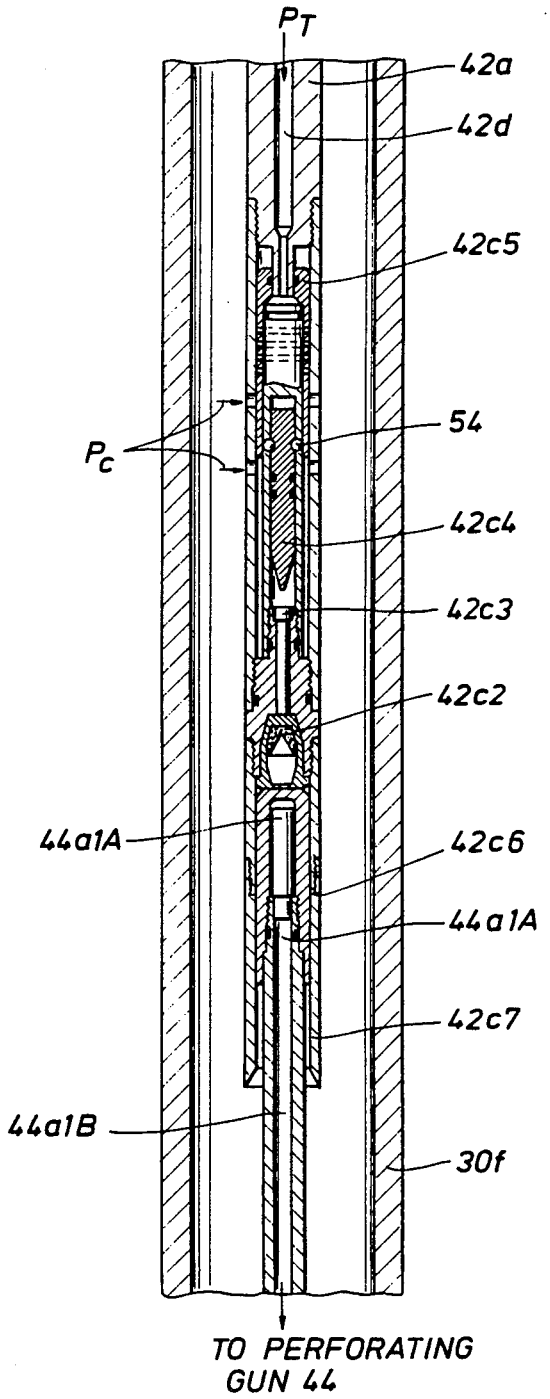

Referring to FIG. 9, a third alternate embodiment of the invention shown in FIG. 4 is illustrated. FIG. 9 is essentially the same embodiment of invention as shown in FIG. 7 of the drawings, except that the intermediate part 30e of the tubing string in FIG. 9 does not contain a sucker rod. Tubing pressure is conveyed through bypass or channel 40a, and through tube 42d in FIG. 9a and 9b. When the tubing pressure arrives at the intermediate part 30e of tubing string 30, the Pt is conveyed through the intermediate space 60 inside intermediate part 30e of tubing string 30. The Pt is further conveyed through port 64 of seal 66, at the other end of the intermediate part 30e of tubing string 30, and into the tube 42d of FIG. 9c. The firing head 42c in FIG. 9c functions identically to the firing head 42c of FIG. 7. The essential purpose of the embodiment shown in FIG. 9 is to increase the distance between pump 40 and firing head 42c by inserting one or more of the intermediate parts 30e of tubing string 30 between top part 30d and bottom part 30f of tubing string 30. If the firing head 42c fails to detonate, pump 40 is pulled to the well surface. When the pump 40 is pulled to the well surface, pipe sections 42a in FIGS. 9a and 9b are pulled to the well surface 40. Seal 66 in FIG. 9b includes a fish neck 70. When the pump 40 and pipe sections 42a in FIGS. 9a and 9b are pulled to the well surface, the pipe section 42a enclosed within the bottom part 30f of tubing string 30, including the firing head 42c, is fished out of the borehole by hooking onto the fish neck 70. When the pipe section 42a and firing head 42c of FIG. 9c are fished out of the wellbore, using fishneck 70, the latch ring 42c6 is sheared, thereby pulling the finger tube 42c7 of firing head 42c over and away from the booster 44a1A. Since the pump 40, pipe sections 42a and firing head 42c are all pulled to the surface, there is no need to pull the tubing string to the surface. A considerable amount of rigtime is saved.

Figure 10:
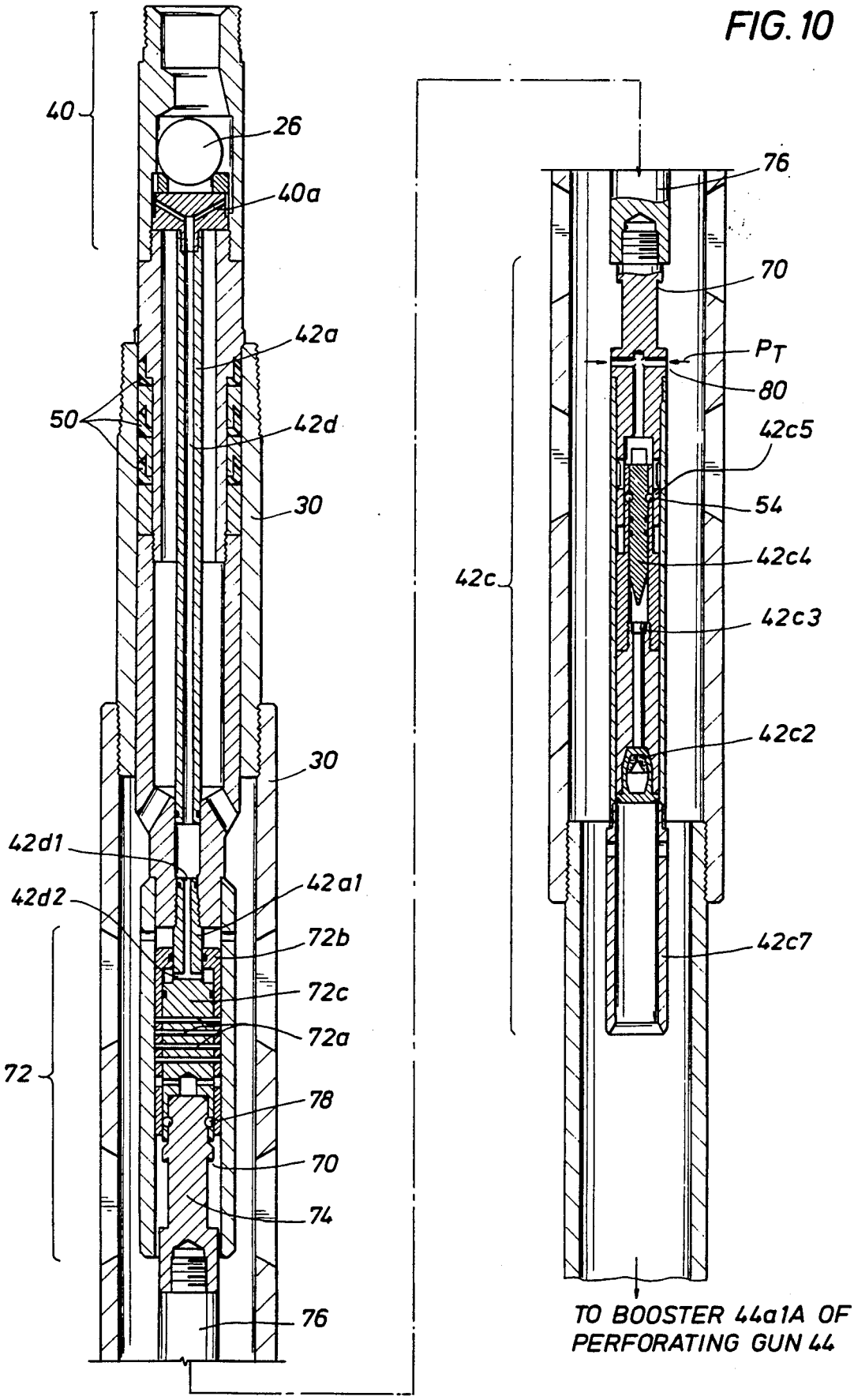
FIG. 10 illustrates a fourth alternate embodiment of the invention illustrated in FIGS. 4 and 5.

Referring to FIG. 10, fourth alternate embodiment of the invention shown in FIG. 4 is illustrated.

The embodiments of FIGS. 7–9 were all concerned about increasing the distance between the pump 40 and the firing head 42c in the pump, since there is no guarantee that the firing head 42c of FIGS. 4 and 6 would be positioned immediate adjacent the booster 44a1A when the pump apparatus 40 of FIG. 3 comes to rest on the top part of the tubing string, as shown in FIG. 4. When the distance between pump 40 and firing head 42c in the pump is increased, in the manner shown with reference to FIGS. 7–9, there is still no guarantee that, for a particular well, the firing head 42c would be positioned immediately adjacent the booster 44a1A. Therefore, one further solution to this problem is suggested: after the new pump apparatus including pump 40 and extension member 42 is inserted into the wellbore and the pump 40 rests on the top part of tubing string 30, physically drop the firing head 42c from its position shown in FIG. 10; after a free fall, firing head 42c will eventually impact the extender tube 44a where the booster 44a1A is located; that is, upon impact, finger tube 42c7 of firing head 42c will surround the extender tube 44a of the perforating gun 44 and charge 42c2 will contact the head 44a1 of extender tube 44a where the booster 44a1A is located. Lock member 42c5 moves downwardly. Tubing pressure Pt will then propel firing pin 42c4 downwardly onto detonator 42c3, firing charge 42c2.

In FIG. 10, a pipe section 42a is connected to a pump 40, the pipe section 42a enclosing a tube or space 42d in which the tubing pressure Pt is carried from bypass/channel 40a. As in other embodiments, seal 50 seals the pipe section 42a from well fluids external to the tubing string 30. Pipe section 42a is connected to a release mechanism 72. The release mechanism 72 includes an internal member 72c, a closure member 72b covering and enclosing the internal member 72c, and shear pins 72a disposed through the closure member 72b and the internal member 72c. The closure member 72b is connected to its own closure member pipe section 42a1. The closure member pipe section 42a1 includes a tube or space 42d1 in which Pt is carried, the space 42d1 ending in a transverse port or space 42d2 which terminates at the underside of closure member 72b. Internal member 72c holds an extender member 74 via ball bearings 78 interposed between internal member 72c and extender member 74. A bar (preferably steel) 76 is connected to the extender member 74, and firing head 42c is connected to the steel bar 76. Extender member 74 includes its own fishneck 70, and firing head 42c also includes its own fishneck 70.

In operation, referring to FIG. 10, tubing pressure Pt is conveyed through bypass or channel 40a in pump 40, through tube 42d enclosed by pipe section 42a, and through tube or space 42d1 of closure member pipe section 42a1. The Pt is then passed into transverse port 42d2 until the passage of the Pt terminates at the underside of closure member 72b. When the Pt is high enough, shear pins 72a shatter, and closure member 72b begins to move upwardly in the drawing. Eventually, the closure member 72b moves over ball bearings 78. Ball bearings 78 fall into its annular recess around extender member 74. This releases the extender member 74. At this point, the extender member 74, steel bar 76, and firing head 42c all drop down into the well. When the firing head 42c nears the vicinity of the extender tube 44a of FIG. 4, during impact of firing head and extender tube, finger tube 42c7 of the firing head 42c surrounds the extender tube 44a and, eventually, charge 42c2 of firing head 42c contacts head 44a1 of extender tube 44a where the booster 44a1A is located. Tubing pressure Pt enters port 80 of firing head 42c and terminates at the underside of lock member 42c5. Lock member 42c5 moves upwardly in response to the Pt, and ball bearings fall into its annular recess, allowing firing pin 42c4 to propel downwardly onto detonator 42c3. Detonator 42c3 fires charge 42c2, which, in turn, sends a detonation wave down primer cord 44a1B, firing the charges in the perforating gun 44. If the firing head 42c fails to detonate, one must remove pump 40 from the well; the removal of pump 40 would remove pipe sections 42a and release mechanism 72. One must then retrieve the extender member 74, steel bar 76, and firing head 42c by hooking onto fishneck 70 of extender member 74, or fishneck 70 of firing head 42c. In any event, it is not necessary to remove the tubing string in order to gain access to the firing head 42c. One need only remove the pump apparatus 40 (which includes release mechanism 72) from the well and then subsequently remove firing head 42c from the bottom of the well.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A method of perforating a well, comprising the steps of:

(a) attaching a perforating gun, devoid of a firing head, to a tubing string and lowering said tubing string, including said perforating gun, into a wellbore;

(b) attaching a firing head to one end of a pipe section and a pump to the other end of said pipe section and lowering said one end of said pipe section, including said firing head, into said tubing string; and (c) detonating said firing head, said perforating gun perforating said well in response to detonation of said firing head.

2. The method of claim 1, wherein the attaching step (b) further comprises the step of:

lowering said one end of said pipe section into said tubing string until said firing head is adjacent a booster of said perforating gun.

3. The method of claim 1, comprising the steps of:

if said firing head fails to detonate, removing said pipe section from said tubing string in order to obtain access to said firing head, whereby the firing head may be repaired or replaced.

4. The method of claim 1, wherein the attaching step (a) further comprises the steps of:

serially attaching one or more additional tubing strings to said tubing string prior to lowering said tubing string, including said perforating gun, into said wellbore.

5. The method of claim 1, wherein the step of lowering said one end of said pipe section into said tubing string in the attaching step (b) further comprises the steps of:

lowering said one end of said pipe section, including said firing head, into said tubing string until said pump rests adjacent said tubing string, the firing head detonating, the perforating gun perforating the well in response to detonation of said firing head.

6. The method of claim 5, comprising the further steps of:

if the firing head fails to detonate, removing said pump and the attached pipe section from said tubing string in order to gain access to said firing head.

7. The method of claim 1, wherein the attaching step (b) further comprises the steps of:

attaching said firing head to said one end of said pipe section;

attaching one end of a sucker rod to the other end of said pipe section;

attaching one end of a further pipe section to the other end of said sucker rod;

attaching said pump to the other end of said further pipe section; and lowering said one end of said pipe section, including said firing head, said sucker rod, and said further pipe section into said tubing string until the pump rests adjacent said tubing string.

8. The method of claim 1, further comprising the steps of:

following the attaching step (b), releasing said firing head from said one end of said pipe section; and dropping said firing head into said wellbore until said firing head impacts a booster of said perforating gun, wherein, during the detonating step (c), the firing head detonates, and the perforating gun perforates the well in response to detonation of said firing head.

9. The method of claim 8, comprising the steps of:

if said firing head fails to detonate, removing said pipe section from within the tubing string, and removing the firing head from the booster of said perforating gun.

10. A method of detonating a perforating apparatus connected to a tubing disposed in a wellbore, comprising the steps of:

attaching a firing head to one end of a pump apparatus and lowering said one end of said pump apparatus including said firing head into said tubing, the other end of said pump apparatus adapted to rest adjacent said tubing when said one end of said pump apparatus including said firing head is lowered into said tubing; and detonating said firing head thereby detonating said perforating apparatus.

11. The method of claim 10, wherein the step of attaching a firing head to one end of said pump apparatus comprises the step of:

increasing a distance between said firing head and said one end of said pump apparatus prior to attaching said firing head to said one end of said pump apparatus, said firing head being disposed adjacent said perforating apparatus in said wellbore when the distance between said firing head and said one end of said pump apparatus is increased and said one end of said pump apparatus including said firing head is lowered into said tubing.

12. The method of claim 11, wherein the increasing step comprises the step of:

interconnecting a sucker rod between said firing head and said one end of said pump apparatus.

13. The method of claim 11, wherein the increasing step comprises the step of:

interconnecting a pipe section between said firing head and said one end of said pump apparatus.

14. The method of claim 10, further comprising the step of:

separating said firing head from said one end of said pump apparatus when said one end of said pump apparatus is lowered into said tubing and the other end of the pump apparatus rests adjacent said tubing, said firing head dropping within said tubing into said wellbore when said firing head is separated from said one end of said pump apparatus, said firing head contacting said perforating apparatus and detonating, said perforating apparatus detonating when the firing head detonates.

15. A method of perforating a formation traversed by a wellbore, comprising the steps of:

(a) connecting a perforating apparatus to a first tubing section;

(b) connecting a firing head to a first pipe section and inserting said first pipe section including said firing head into said first tubing section;

(c) connecting a pump to a second pipe section and inserting said second pipe section into a second tubing section until said pump rests adjacent said second tubing section;

(d) inserting a sucker rod into a third tubing section;

(e) interconnecting said sucker rod between said first pipe section and said second pipe section while substantially simultaneously interconnecting said third tubing section between said first tubing section and said second tubing section;

(f) lowering the first, third and second tubing sections into said wellbore;

(g) detonating said firing head; and (h) detonating said perforating apparatus.

* * * * *